US010821752B2

(12) United States Patent
Hirao

(10) Patent No.: US 10,821,752 B2
(45) Date of Patent: Nov. 3, 2020

(54) IMAGE FORMING APPARATUS CONTROLLING OVERLAP OF CONSECUTIVE SHEETS, METHOD OF CONTROLLING THE SAME, AND STORAGE MEDIUM

(71) Applicant: CANON KABUSHIKI KAISHA, Tokyo (JP)

(72) Inventor: Toyomi Hirao, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/208,923

(22) Filed: Dec. 4, 2018

(65) Prior Publication Data

US 2019/0168519 A1 Jun. 6, 2019

(30) Foreign Application Priority Data

Dec. 6, 2017 (JP) ..... 2017-234303

(51) Int. Cl.
*B41J 11/44* (2006.01)
*B65H 7/02* (2006.01)
*B41J 13/00* (2006.01)

(52) U.S. Cl.
CPC ..... *B41J 11/44* (2013.01); *B41J 13/0009* (2013.01); *B65H 7/02* (2013.01)

(58) Field of Classification Search
CPC .... B41J 11/44; B41J 13/0009; B41J 13/0027; B41J 11/008; B65H 7/02
See application file for complete search history.

(56) References Cited

U.S. PATENT DOCUMENTS

2011/0075170 A1* 3/2011 Harada ..... H04N 1/41 358/1.9
2016/0342870 A1* 11/2016 Saito ..... G06K 15/4025
2017/0274682 A1* 9/2017 Ide ..... B41J 13/0027

FOREIGN PATENT DOCUMENTS

JP 2000-062975 A 2/2000
JP 2016-165833 A 9/2016

* cited by examiner

*Primary Examiner* — Iriana Cruz
(74) *Attorney, Agent, or Firm* — Venable LLP

(57) ABSTRACT

An image forming apparatus is configured to form an image on a sheet on the basis of image data, and the apparatus obtains, on the basis of image data that has been coded, a first blank amount on a leading end side of a succeeding sheet coming after a preceding sheet, and obtains a second blank amount on a trailing end side of the preceding sheet on the basis of the image data that has been coded. Controlling is performed to feed the succeeding sheet to cause the succeeding sheet to overlap with the preceding sheet by the length corresponding to a blank amount being the smaller of the first blank amount and the second blank amount, and to form an image.

16 Claims, 11 Drawing Sheets

411 410

| ADDRESS | 00 | 01 | 02 | 03 | 04 | 05 | 06 | 07 | 08 | 09 | 0A | 0B | 0C | 0D | 0E | 0F |
|---|---|---|---|---|---|---|---|---|---|---|---|---|---|---|---|---|
| 00000260 | BA | C2 | C3 | C4 | C5 | C6 | C7 | C8 | C9 | CA | D2 | D3 | D4 | D5 | D6 | D7 |
| 00000270 | D8 | D9 | DA | E2 | E3 | E4 | E5 | E6 | E7 | E8 | E9 | EA | F2 | F3 | F4 | F5 |
| 00000280 | F6 | F7 | F8 | F9 | FA | FF | DA | 00 | 0C | 03 | 01 | 00 | 02 | 11 | 03 | 11 |
| 00000290 | 00 | 3F | 00 | FD | FC | A2 | 8A | 28 | 00 | A2 | 8A | 28 | 00 | A2 | 8A | 28 |
| 000002A0 | 00 | A2 | 8A | 28 | 00 | A2 | 8A | 28 | 00 | A2 | 8A | 28 | 00 | A2 | 8A | 28 |
| 000002B0 | 00 | A2 | 8A | 28 | 00 | A2 | 8A | 28 | 00 | A2 | 8A | 28 | 00 | A2 | 8A | 28 |
| 000002C0 | 00 | A2 | 8A | 28 | 00 | A2 | 8A | 28 | 00 | A2 | 8A | 28 | 00 | A2 | 8A | 28 |
| 000002D0 | 00 | A2 | 8A | 28 | 00 | A2 | 8A | 28 | 00 | A2 | 8A | 28 | 00 | A2 | 8A | 28 |
| 000002E0 | 00 | A2 | 8A | 28 | 00 | A2 | 8A | 28 | 00 | A2 | 8A | 28 | 00 | A2 | 8A | 28 |
| 000002F0 | 00 | A2 | 8A | 28 | 00 | A2 | 8A | 28 | 00 | A2 | 8A | 28 | 00 | A2 | 8A | 28 |
| 00000300 | 00 | A2 | 8A | 28 | 00 | A2 | 8A | 28 | 00 | A2 | 8A | 28 | 00 | A2 | 8A | 28 |

JPEG COMPRESSED DATA EXAMPLE 411 410

| ADDRESS | 00 | 01 | 02 | 03 | 04 | 05 | 06 | 07 | 08 | 09 | 0A | 0B | 0C | 0D | 0E | 0F |
|---|---|---|---|---|---|---|---|---|---|---|---|---|---|---|---|---|
| 00000260 | BA | C2 | C3 | C4 | C5 | C6 | C7 | C8 | C9 | CA | D2 | D3 | D4 | D5 | D6 | D7 |
| 00000270 | D8 | D9 | DA | E2 | E3 | E4 | E5 | E6 | E7 | E8 | E9 | EA | F2 | F3 | F4 | F5 |
| 00000280 | F6 | F7 | F8 | F9 | FA | FF | DA | 00 | 0C | 03 | 01 | 00 | 02 | 11 | 03 | 11 |
| 00000290 | 00 | 3F | 00 | FD | FC | A2 | 8A | 28 | 00 | A2 | 8A | 28 | 00 | A2 | 8A | 28 |
| 000002A0 | 00 | A2 | 8A | 28 | 00 | A2 | 8A | 28 | 00 | A2 | 8A | 28 | 00 | A2 | 8A | 28 |
| 000002B0 | 00 | A2 | 8A | 28 | 00 | A2 | 8A | 28 | 00 | A2 | 8A | 28 | 00 | A2 | 8A | 28 |
| 000002C0 | 00 | A2 | 8A | 28 | 00 | A2 | 8A | 28 | 00 | A2 | 8A | 28 | 00 | A2 | 8A | 28 |
| 000002D0 | 00 | A2 | 8A | 28 | 00 | A2 | 8A | 28 | 00 | A2 | 8A | 28 | 00 | A2 | 8A | 28 |
| 000002E0 | 00 | A2 | 8A | 28 | 00 | A2 | 8A | 28 | 00 | A2 | 8A | 28 | 00 | A2 | 8A | 28 |
| 000002F0 | 00 | A2 | 8A | 28 | 00 | A2 | 8A | 28 | 00 | A2 | 8A | 28 | 00 | A2 | 8A | 28 |
| 00000300 | 00 | A2 | 8A | 28 | 00 | A2 | 8A | 28 | 00 | A2 | 8A | 28 | 00 | A2 | 8A | 28 |

JPEG COMPRESSED DATA EXAMPLE

IMAGE FORMING APPARATUS CONTROLLING OVERLAP OF CONSECUTIVE SHEETS, METHOD OF CONTROLLING THE SAME, AND STORAGE MEDIUM

BACKGROUND OF THE INVENTION

Field of the Invention

The present invention relates to an image forming apparatus, a method of controlling the image forming apparatus, and a storage medium.

Description of the Related Art

Conventionally, preceding feeding is well known, in which a succeeding sheet starts to be conveyed before printing to the preceding sheet is completed, to improve throughput of the print processing. For example, Japanese Patent Laid-Open No. 2000-062975 describes an image forming apparatus that obtains, from printing information, a printing area of a sheet on which an image is printed, and conveys sheets to overlap with each other by the amount for which printing areas do not overlap with each other. In addition, Japanese Patent Laid-Open No. 2016-165833 describes a technique that analyzes image data to be printed, to calculate the amount of the sheet for which image printing areas do not overlap with each other.

In the case of the method described in Japanese Patent Laid-Open No. 2016-165833 described above, image data is developed in a memory as a bitmap, and calculation is made on a pixel-by-pixel basis to obtain an overlapping area that extends up to the line where image data that does not indicate white (R=255, G=255, and B=255) exists. This method involves reading out image data for each pixel from the memory to determine whether or not the pixel is white, and hence, requires a large amount of time. In addition, in the case where software is used to read out the image data from the memory for each pixel to perform the determination described above, the CPU has to bear a large amount of load.

SUMMARY OF THE INVENTION

An aspect of the present invention is to eliminate the above-mentioned problem with conventional technology.

A feature of the present invention is to provide a technique that improves performance of image formation by obtaining the overlapping amount between the preceding sheet and the succeeding sheet to perform preceding feeding.

According to a first aspect of the present invention, there is provided an image forming apparatus for forming an image on a sheet on the basis of image data, the image forming apparatus comprising: a memory device configured to store a set of instructions; at least one processor configured to execute the instructions stored in the memory to function as: a first obtaining unit configured to obtain, on the basis of image data that has been coded, a first blank amount on a leading end side of a succeeding sheet coming after a preceding sheet; a second obtaining unit configured to obtain a second blank amount on a trailing end side of the preceding sheet on the basis of the image data that has been coded; and a control unit configured to control to feed the succeeding sheet to cause the succeeding sheet to overlap with the preceding sheet by a length corresponding to a blank amount being smaller of the first blank amount and the second blank amount, and to form an image.

According to a second aspect of the present invention, there is provided a method of controlling an image forming apparatus configured to form an image on a sheet on the basis of image data, the method comprising: obtaining, on the basis of image data that has been coded, a first blank amount on a leading end side of a succeeding sheet coming after a preceding sheet; obtaining a second blank amount on a trailing end side of the preceding sheet on the basis of the image data that has been coded; and controlling to feed the succeeding sheet to cause the succeeding sheet to overlap with the preceding sheet by a length corresponding to a blank amount being smaller of the first blank amount and the second blank amount, and to form an image.

Further features of the present invention will become apparent from the following description of exemplary embodiments with reference to the attached drawings.

BRIEF DESCRIPTION OF THE DRAWINGS

The accompanying drawings, which are incorporated in and constitute a part of the specification, illustrate embodiments of the invention and, together with the description, serve to explain the principles of the invention.

DESCRIPTION OF THE EMBODIMENTS

Embodiments of the present invention will be described hereinafter in detail, with reference to the accompanying drawings. It is to be understood that the following embodiments are not intended to limit the claims of the present invention, and that not all of the combinations of the aspects that are described according to the following embodiments are necessarily required with respect to the means to solve the problems according to the present invention.

Figure 1:
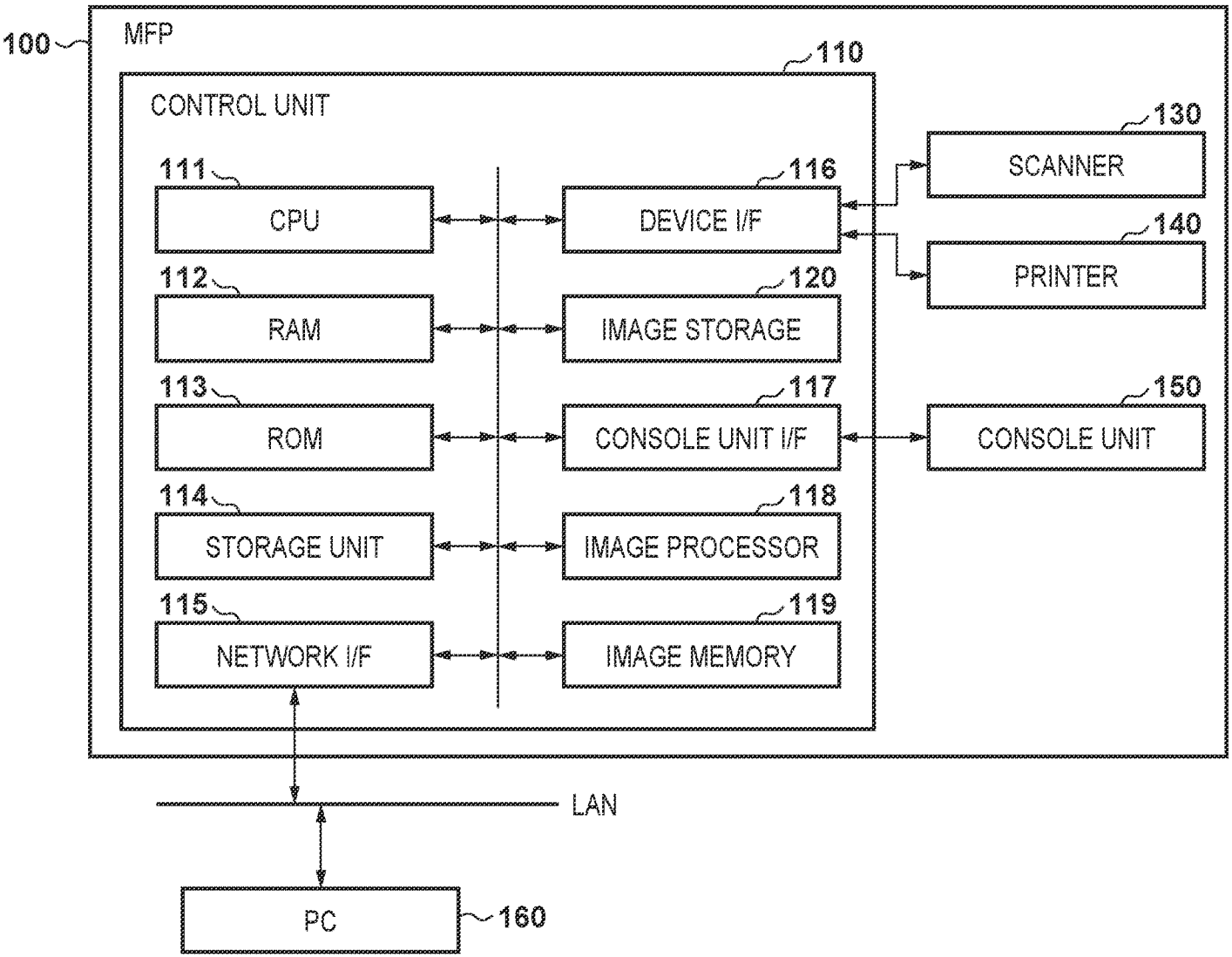
FIG. 1 is a block diagram for explaining the configuration of an image forming apparatus (MFP) according to an exemplary embodiment of the present invention.

FIG. 1 is a block diagram for explaining the configuration of an image forming apparatus (MFP) according to an exemplary embodiment of the present invention.

This exemplary embodiment will describe, as an example of an image forming apparatus, a multi-function peripheral (MFP) 100 that has a scan function, a box function, a facsimile function, and the like. However, the image forming apparatus may be a printer (print apparatus) that mainly has only a printing function. A control unit 110 is connected to a scanner 130 and a printer 140, and configured to control input/output of image information. In addition, the control unit 110 is connected to a LAN, and, for example, receives a print job through the LAN.

A CPU 111 executes a boot program held in a ROM 113, deploys a program held in a storage unit 114 into a RAM 112, and executes the deployed program to control operations of the MFP 100. The ROM 113 is a boot ROM, and holds the boot program or various setting data or the like. The storage unit 114 is a mass storage device such as a hard disk drive (HDD) and SDD, and holds, for example, software, image data, and programs for controlling operations of the MFP 100.

A network I/F 115 is connected to the LAN, and communicates with external devices such as a PC 160 through the LAN, thereby controlling input/output of various types of information. A device I/F 116 connects the scanner 130 or the printer 140 with the control unit 110, and converts between synchronous and asynchronous of image data. A console unit I/F 117 connects a console unit 150 and the control unit 110, and outputs, to the console unit 150, image data to be displayed on the console unit 150. In addition, the console unit I/F 117 transmits, to the CPU 111, information that a user inputs from the console unit 150. The console unit 150 has a touch panel function. An image processor 118 performs image processing to the print data received through the LAN, and performs image processing to image data that are inputted or outputted through the device I/F 116. This image processor 118 may be configured with hardware such as an application specific integrated circuit (ASIC), or may be configured with the CPU 111 and software including a program. An image memory 119 is a memory for temporarily storing image data to be processed by the image processor 118 to perform image processing. The image memory 119 is achieved by a volatile storage medium such as a DRAM. An image storage 120 is achieved by a non-volatile storage medium such as an HDD and a SSD, and is used in the case where data in the image memory 119 is used continuously and the data need to be reused after the MFP 100 is powered off. The use of the image storage 120 enables a file system provided by the operating system to be establish on the HDD and the like to accumulate image data on a file basis. The image processor 118 executes image processing to bitmap data represented in color space of, for example, RGB or CMYK. Image data stored in the image memory 119 and the image storage 120 is accumulated as coded data obtained by compressing the bitmap data described above with an image compression method such as JPEG, JBIG and PNG with the aim of reducing the amount of data. The bitmap data may be accumulated as it is without compression as long as the capacity of the memory is available. In addition, the method for compressing the bitmap data may be a general compression method such as JPEG and JBIG, or it may be possible to use a special compression method in the case of data remaining in the MFP 100.

Figure 2:
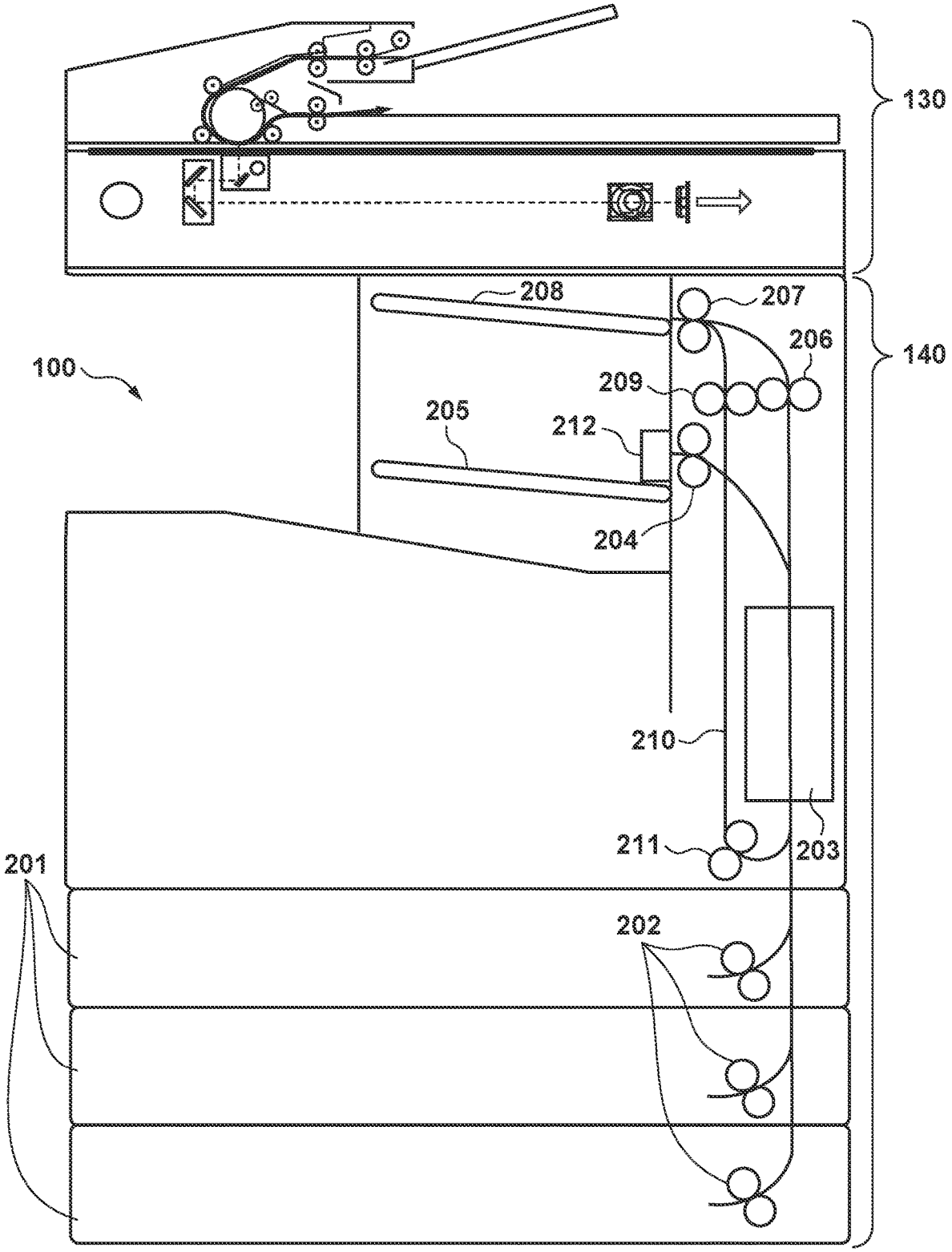
FIG. 2 depicts a perspective view illustrating the MFP according to the exemplary embodiment.

FIG. 2 depicts a perspective view illustrating the MFP 100 according to the exemplary embodiment.

The MFP 100 includes the scanner 130 disposed above the printer 140. A sheet feeding unit 201 holds sheets to use for printing. The MFP 100 includes three sheet feeding units. However, the number of the sheet feeding units is not limited to three. Conveyance rollers 202 respectively convey sheets held in the sheet feeding unit 201, to a printing unit 203. At this time, if the overlapping amount, which will be described later, is set, sheets are conveyed in a manner such that part of the succeeding sheet overlaps with the preceding sheet. The printing unit 203 prints an image on the fed sheet. The printing unit 203 may employ an inkjet type in which an image is printed by jetting ink onto the sheet, or an electrophotographic method in which an image is printed by fixing toners on the sheet. The sheet with the image printed by the printing unit 203 passes through the conveyance roller 204, and is discharged to a discharge tray 205. In the case of the double-sided printing, the sheet with the image printed on the first side is sent to a tray 208 through feeding rollers 206, 207, rather than through the conveyance roller 204, and then, is sent to a double-sided conveyance path 210 by the feeling rollers 207 and 209 that rotate backward. After this, the sheet is sent through a conveyance roller 211 to the printing unit 203 again, and another image is printed on the second side of this sheet. A staple device 212 can staple sheets outputted to the discharge tray 205.

In the exemplary embodiment, image data is obtained by the scanner 130. Alternatively, page description language (PDL) data is received through the network I/F 115, and the CPU 111 applies rendering to the received data to obtain image data. The image data is used to obtain image data to be subjected to necessary image processing by the image processor 118. The thus obtained image data (bitmap data) is compressed to obtain coded data, and the coded data is accumulated in the image storage 120 through the image memory 119. At the time of printing, the coded data accumulated in the image storage 120 is read out to the image memory 119, and is decoded by the image processor 118, and is performed image processing suitable for printing. Then, the image data (bitmap data) that have been subjected to the conversion is output to the printer 140, and is printed.

It should be noted that the exemplary embodiment gives an example in which monochrome binary bitmap data is outputted to the printer 140. However, in the present invention, image data outputted to the printer 140 is not limited to the monochrome binary bitmap data. In addition, the exemplary embodiment describes that monochrome binary image data is processed as image data compressed with JBIG. However, the image compression algorithm is not limited to JBIG. For example, MMR/MR/MH or any other compression algorithm may be used if it is the monochrome binary compression method. In addition, JPEG or PNG may be used as a compression algorithm in the case where image data with grayscale or RGB dot sequence is compressed.

Figure 3:
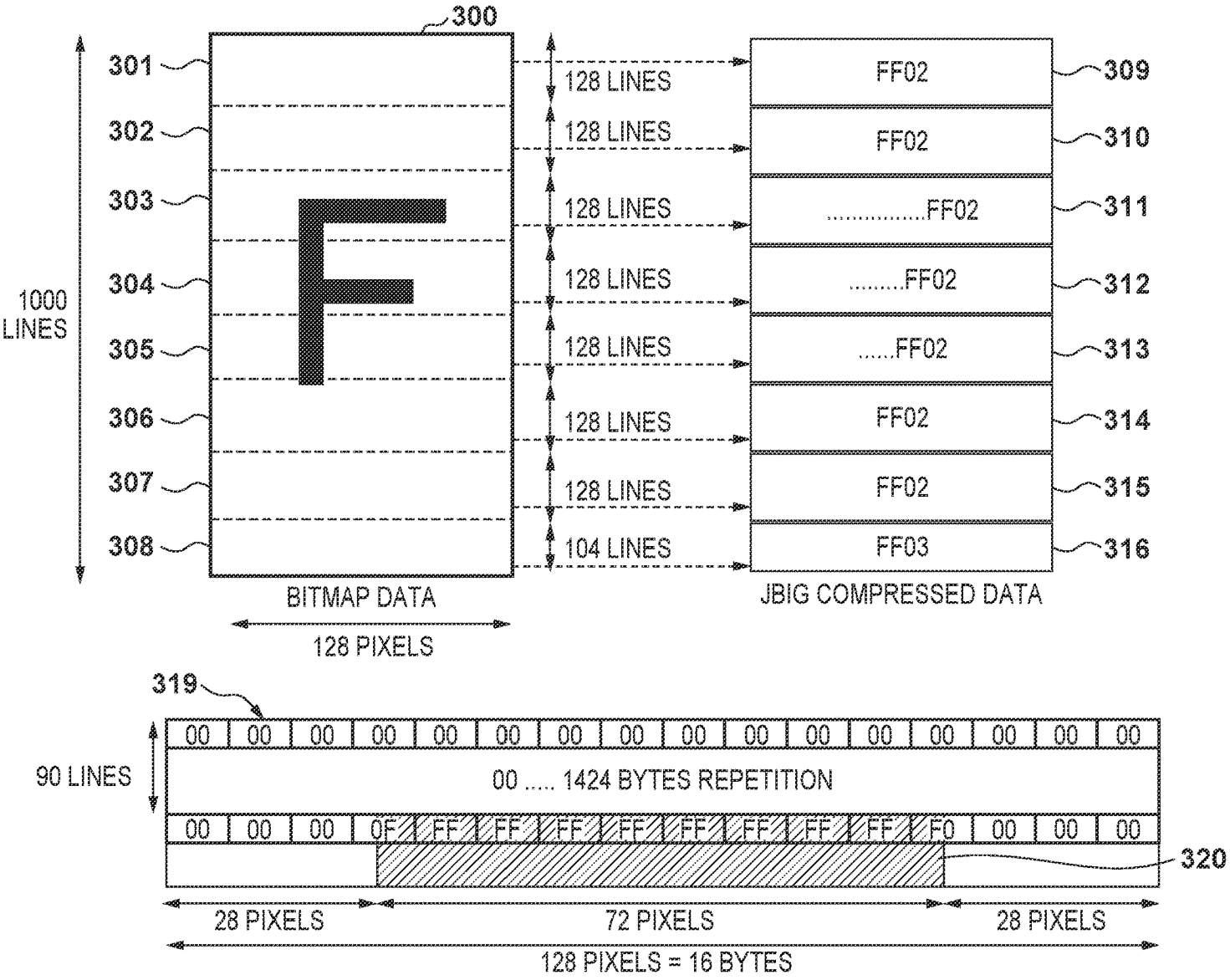
FIG. 3 is a diagram for explaining an example of image data (bitmap data) and JBIG code according to the exemplary embodiment.

FIG. 3 is a diagram for explaining an example of image data (bitmap data) and JBIG code according to the exemplary embodiment. Note that operations described below are achieved as a control program that operates in the CPU 111, and also achieved as operations of the image processor 118 that operates with parameters being set by the control program.

As an example, bitmap data 300 formed in the image memory 119 indicates an image having 128 pixels in the main scanning direction and 1000 lines in the sub-scanning direction. However, this is given merely as an example for the purpose of explanation, and this is not intended to limit the present invention. When the bitmap data 300 is subjected to JBIG compression, the bitmap data 300 is divided at every 128 lines into multiple stripe data 301 to 308 and is coded, to compress the data as 128 lines included in one stripe. Note that the total number of lines of the bitmap data 300 is 1000 lines, and hence, the last stripe data is configured with 104 lines. In addition, in the bitmap image in the drawing, "1" represents a black pixel and "0" represents a white pixel. However, "0" may represent a black pixel and "1" may represent a white pixel.

A JBIG compression unit of the image processor 118 codes the stripe data 301 to 308 to generate JBIG codes indicated as coded data 309 to 316, respectively. The JBIG codes are characterized in that, in the case where no bit of "1" exists in a single stripe that has been coded, only the stripe end code SDNORM (FF02) is generated or only the reset code SDRST (FF03) at the end of the stripe is generated. In other words, data obtained by coding the stripe data 301 and 302 and the stripe data 306 to 308 is coded data of "FF02" or "FF03" having two bytes as indicated in the coded data 309, 310, 314, 315, 316, respectively. Thus, in the case where coded data including "FF02" or "FF03" is continuing, it means that there are blank areas of 128 lines, the amount of which corresponds to the number of the continuing coded data including "FF02" or "FF03". For example, as for the coded data 309 and 310, "FF02" continues twice from the leading edge of the image data, and hence, on the basis of the coded data, the 256 (=128×2) lines at the leading end of the image data are judged to be blank areas.

Reference numeral 319 denotes the stripe data 303 in an enlarged manner. The stripe data 303 is image data represented as one bit per pixel. In the drawing, "00" represents 8 consecutive white pixels (one byte), and the top line contains 16 bytes (16 pieces of "00") and 128 pixels, in other words, represents one line of blank space. The gray portion 320 in the stripe data 319 corresponds to the upper side portion of the character "F" illustrated in the bitmap data 300, and lines that contain data other than "00" start to appear from the position of the 1440 bytes (90th line) counting from the top of the stripe data 319. In other words, the number of bytes is counted from the top of the stripe data 303 to the position where a pixel of other than zero exists. The counted number is divided by 16 (=128 pixels/8), which is the amount of image data per line. The resulting value is the number of blank lines obtained by analyzing the stripe data 303. Thus, in the case of this example, the blank space from the top end of the image data 300 being calculated on the basis of the coded data can be judged to exist including 346 lines of the leading blank lines, the 346 is obtained as the total value of the 128×2 and 1440/16=90, which is the blank space calculated through analysis of the stripe data 303.

In addition, the number of blank lines on the trailing side of the character "F" can be calculated by making similar judgment from the trailing end of the bitmap data and the coded data in the image memory 119, thereby obtaining the number of trailing blank lines. However, the calculation method differs in one point from the computation for the number of leading blank lines. In the case where the number of trailing blank lines is calculated on the basis of the coded data, calculation is made on the basis of {(counted value of continuing "FF02" or "FF03"−1)×128)} lines.

Figure 4:
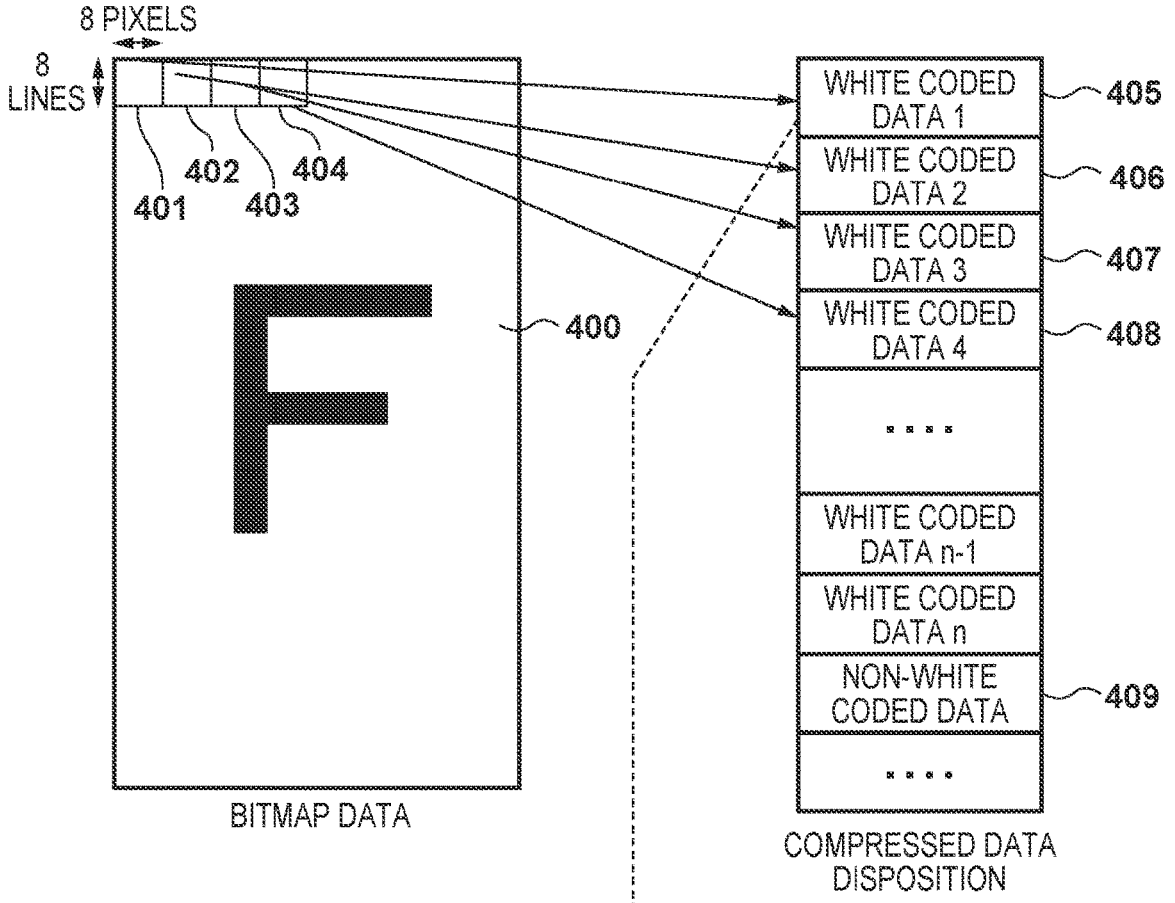
FIG. 4 is a diagram for explaining an example in which JPEG compression is applied to grayscale.

FIG. 4 is a diagram for explaining an example in which JPEG compression is applied to grayscale. Here, description will be made using image data 400 containing a character "F" as an example.

At the time of JPEG compression, bitmap data is divided into rectangular shapes (blocks) with 8×8 pixels, and then, is compressed, for reasons of compression algorithm. Thus, algorithm for computing the number of blank lines on the basis of coded data differs. In addition, due to the Huffman table used for coding, coded data may differ even in the case where the same data is coded. Thus, in a case of calculating the number of blank lines from the JPEG codes, it is necessary to perform the calculation after having compressed white code in advance by using the Huffman table to be used. Alternatively, it may be possible to dynamically compress white code data as a test in advance, and use the compressed data as template data. As an example, the white code data after white data is compressed is illustrated as 410. Here, the blocks 401 to 404 are white areas, and hence, coded data thereof result in white coded data 405 to 408, respectively. Furthermore, coded data for a block that contains part of the character "F" results in non-white coded data 409.

A JPEG code contains header data for identifying the size of an image and color space information. The leading edge position of the image is located at the position of the block 401, and from this position, a pattern of "A28A2800" 411 continues. By counting the number of continuations of the pattern, it is possible to identify the number of 8×8-pixel blocks with white data, and calculate the number of leading blank lines on the basis of the identified number.

Figure 5:
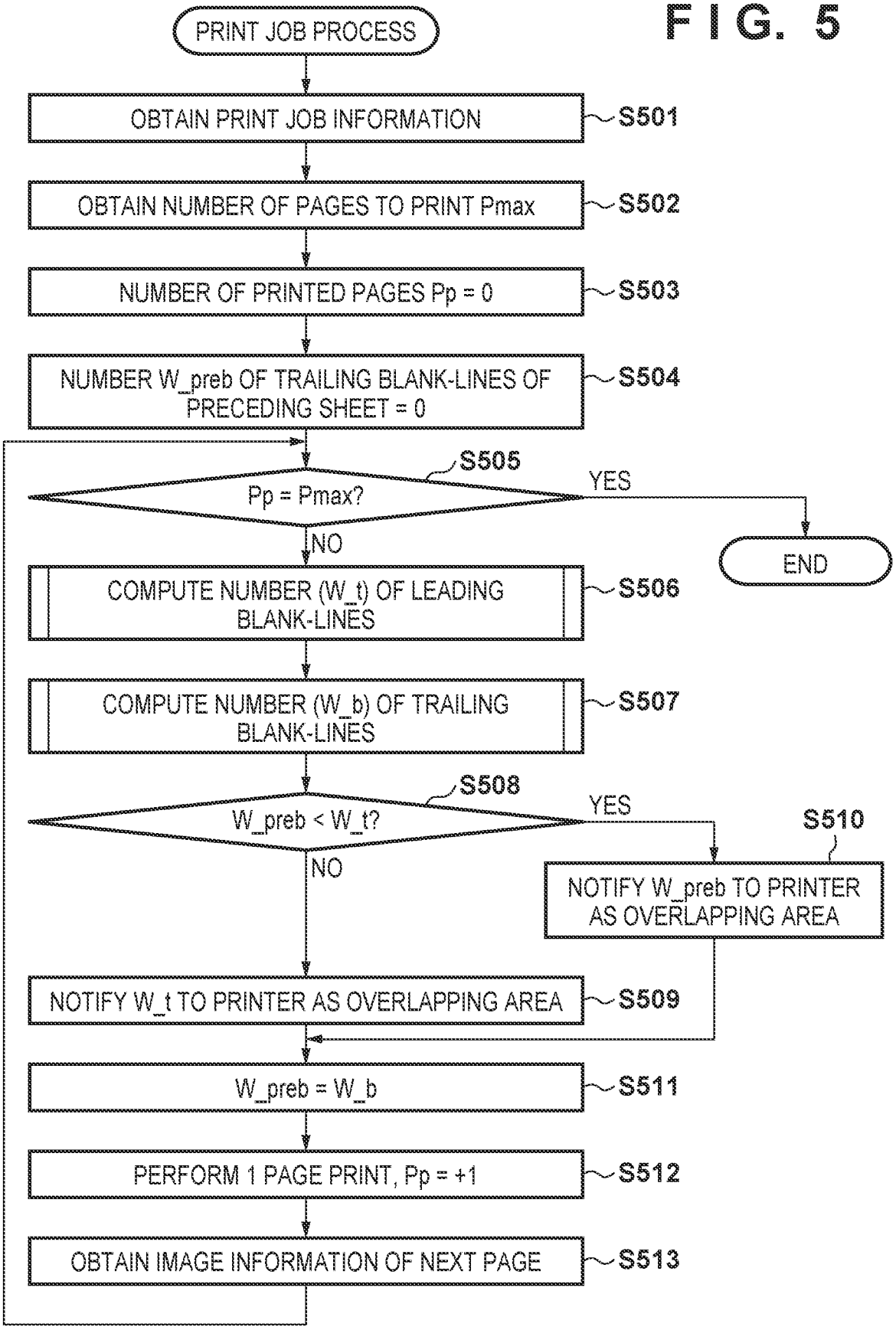
FIG. 5 is a flowchart for describing processing at the time of performing a print job by the MFP according to the exemplary embodiment.

FIG. 5 is a flowchart for describing processing at the time of performing a print job by the MFP 100 according to the exemplary embodiment. Note that the process shown in the flowchart is achieved by executing the programs deployed in the RAM 112 by the CPU 111.

It should be noted that, in the exemplary embodiment, description will be made of an example in which the number of blank lines is not computed at the time of accumulation of image data, and the number of blank lines is computed at the time of executing printing. However, it may be possible to compute the number of leading blank lines and the number of trailing blank lines of image data and store them at the time of accumulation of the image data. In addition, in the exemplary embodiment, description will be made of an example in which rotation processing is not performed to image data. However, it may be possible to rotate image data, then, perform coding again, and compute the number of blank lines. Furthermore, in the case where image data is rotated, it may be possible to calculate the number of blank lines only through analysis of bitmap data without calculation of the number of blank lines on the basis of coded data.

This processing is started by an instruction of start of a print job made by a user. First, the CPU 111 obtains information on the print job in step S501. This information on the print job contains the number of pages to be printed, information on color or monochrome print, the size of an image of image data to be printed, the size of sheet to which printing is performed, and the like. Next, the flow advances to step S502. The CPU 111 obtains the total number of pages to be printed through the print job to save the obtained total number in the variable Pmax reserved in the RAM 112. Then, the flow advances to step S503. The CPU 111 reserves, in the RAM 112, a variable of Pp that saves the number of pages that have been printed, and initializes the Pp with "0". Note that these values of variables Pp, Pmax are used for termination determination of the print job. Next, the flow advances to step S504. The CPU 111 reserves, in the RAM 112, a variable W_preb that saves the number of trailing blank lines of the preceding sheet, and initializes it with "0".

Note that, in the exemplary embodiment, the smaller one of the number of trailing blank lines of the preceding sheet and the number of leading blank lines of the succeeding sheet is used as the amount of blank for which overlapping conveyance is possible.

Next, the flow advances to step S505. The CPU 111 compares the Pmax and the Pp to determine whether printing ends, and determines that printing ends if the value of the Pmax and the value of the Pp match, thereby ending this process. On the other hand, if the value of the Pmax and the value of Pp do not match in step S505, printing of the succeeding page is necessary, and hence, the flow advances to step S506. In step S506, the CPU 111 obtains the number W_t of leading blank lines of a sheet (the succeeding sheet) to be printed next. Next, the flow advances to step S507. The CPU 111 obtains the number W_b of training blank lines of the sheet to be printed next. Note that details of the processes in step S506 and step S507 will be described later with reference to the flowcharts in FIGS. 6 to 9.

After step S506 and step S507 are performed as described above, the flow advances to step S508. The CPU 111 compares the number W_preb of trailing blank lines of the preceding sheet with the number W_t of leading blank lines of the succeeding sheet obtained in step S506. This is because, as described above, the smaller one of the number of trailing blank lines of the preceding sheet and the number of leading blank lines of the succeeding sheet is used as the amount of blank for which overlapping conveyance is possible. As a result of comparison in step S508, the smaller blank amount of the number W_t of leading blank lines and the number W_preb of trailing blank lines of the preceding page is notified to the printer 140. In other words, if the number W_t of leading blank lines is smaller, the flow advances to step S509, and the CPU 111 notifies the printer 140 of the number W_t of leading blank lines as the amount of blank for which overlapping conveyance is possible. On the other hand, if the number W_preb of trailing blank lines of the preceding sheet is smaller, the flow advances to step S510, and the CPU 111 notifies the printer 140 of the number W_preb of trailing blank lines of the preceding sheet as the amount of blank for which overlapping conveyance is possible. Note that the process for the printer 140 to receive the amount of blank for which overlapping conveyance is possible to perform printing will be described later with reference to the flowcharts in FIGS. 10A and 10B.

Note that, in the exemplary embodiment, the W_preb, the W_t, and the W_b represent the number of lines of the blank area. However, the present invention is not limited to this. For example, it may be possible to convert such information into a unit of length such as cm and mm, and notify it. Alternatively, it may be possible to convert the entire sheet into block units such that the entire sheet is divided into plural blocks, and obtain a particular block up to which overlapping is possible to report it.

As described above, after step S509 or step S510 is performed, the flow advances to step S511. The CPU 111 stores the number of trailing blank lines W_b of the succeeding sheet described in step S507 in the number of trailing blank lines W_preb of the preceding sheet, to obtain the amount of blank for which overlapping conveyance is possible. Next, the flow advances to step S512. The CPU 111 performs a print processing for one page, and then, increases the number of pages Pp that has been printed, by one (+1). After this, the flow advances to step S513. The CPU 111 obtains information on a print page to process data on the next page, and then, the flow returns to step S505.

By repeating the process described above, it is possible to perform printing from the top page to the last page of a print job, while performing preceding feeding in which the preceding sheet and the succeeding sheet are conveyed in a state where the trailing end side of the preceding sheet overlaps with the leading end side of the succeeding sheet. Note that, as for the top page of a print job, there is no page to be overlapped with. Thus, even if notification to the printer 140 is made, the printer 140 is assumed to ignore the notification. Alternatively, as for the top page of a print job, the number of lines to be overlapped with may not be notified to the printer 140. In addition, although the number of trailing blank lines is computed for the last page of a print job, this computation may not be necessary because there is no sheet feeding to be overlapped with the trailing blank space of the preceding sheet (and also no print data) in the case of the last page of the print job.

Figure 6:
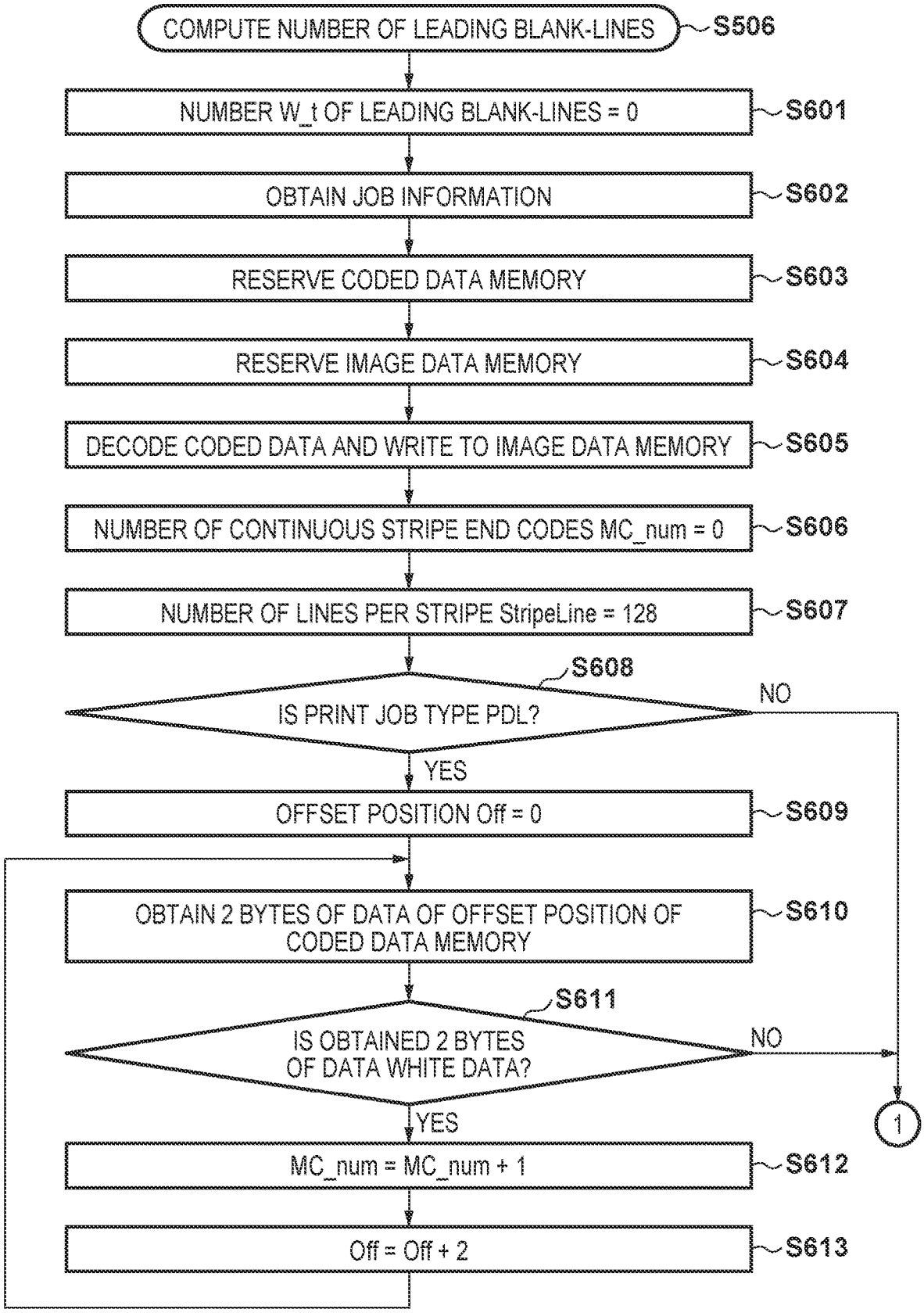
FIG. 6 is a flowchart for describing calculation processing for the number of leading blank lines in step S506 in FIG. 5.
Figure 7:
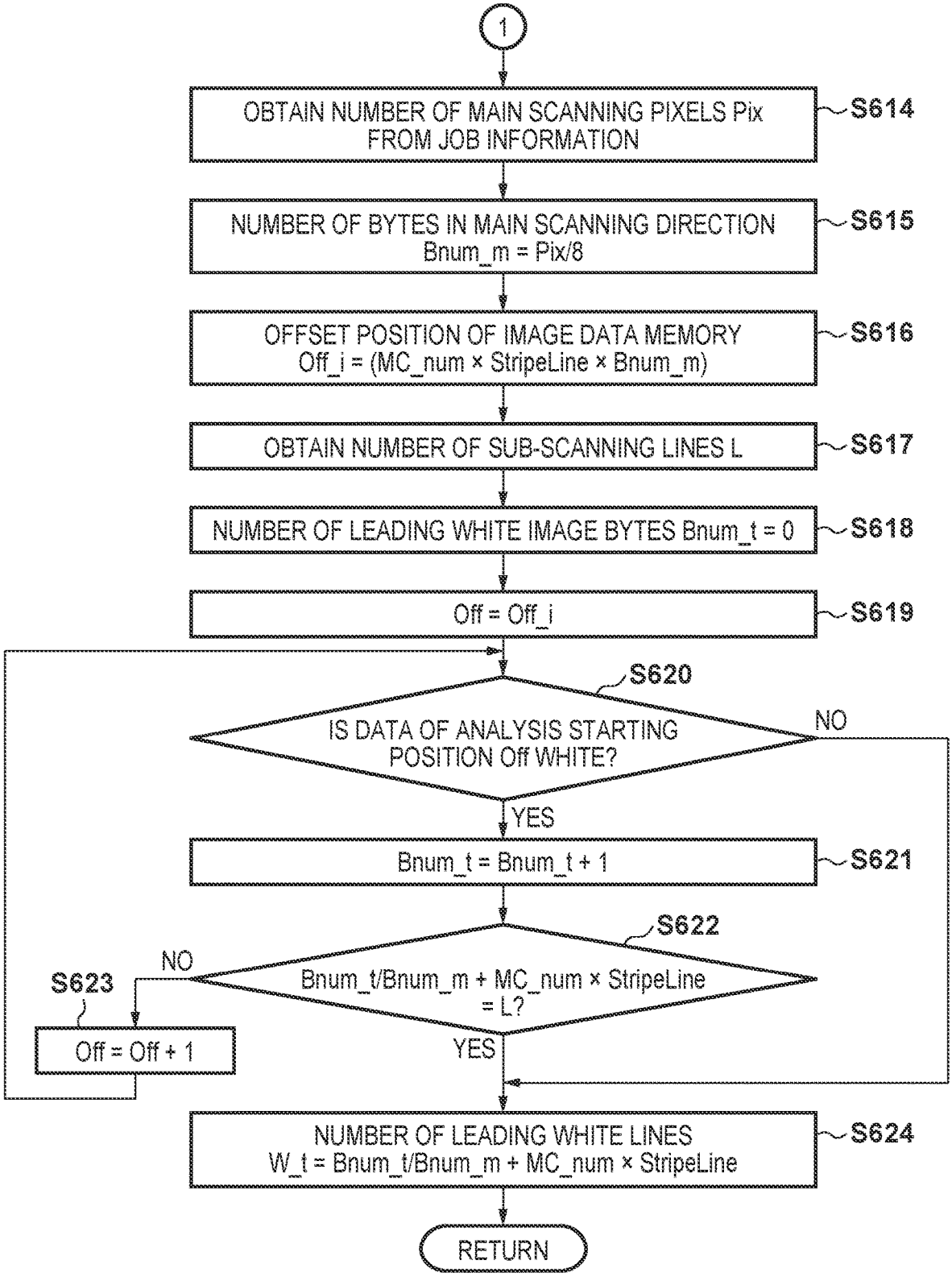
FIG. 7 is a flowchart for describing calculation processing for the number of leading blank lines in step S506 in FIG. 5.

FIGS. 6 and 7 are flowcharts for describing calculation processing for the number of leading blank lines in step S506 in FIG. 5. Note that, in the exemplary embodiment, it is not considered in the case where the original contains a blank sheet, in other words, for example, in the case where a blank sheet is contained. If a blank sheet is included, computation is performed such that the amount of leading blank space and the amount of the trailing blank space are assumed to be a half of the sheet size of the blank sheet.

First, in step S601, the CPU 111 reserves, in the RAM 112, a variable W_t that saves the number of leading blank lines, and initializes it with "0". The flow advances to step S602. The CPU 111 obtains job information containing details of image data. The flow advances to step S603. The CPU 111 reserves, in the image memory 119, a coded data memory for reading coded data necessary for obtaining image information. The flow advances to step S604. The CPU 111 reserves, in the image memory 119, an image data memory for holding image data obtained by decoding the coded data. The flow advances to step S605. The CPU 111 reads out the coded data held in the image storage 120 into the coded data memory. Then, the coded data is decoded into bitmap data using a JBIG decoder of the image processor 118, and the bitmap data is held in the image data memory. As a specific example, data disposed in the coded data memory is shown as 309 to 316 illustrated in FIG. 3, and data disposed in the image data memory is shown as 301 to 308 in FIG. 3.

Next, the CPU 111 further reserves a necessary variable in the RAM 112, and initializes it. First, in step S606, the CPU 111 reserves the number of continuous stripe end codes MC_num in the RAM 112, and initializes it with "0". In the exemplary embodiment, this MC_num will be described as an example in which JBIG compression is applied, and hence, is a variable for counting the number of SDRST (FF03) and SDNORM (FF02) that continue in JBIG code. Next, the flow advances to step S607. The CPU 111 reserves, in the RAM 112, a variable StripeLine that indicates the number of lines per stripe, and initializes it with "128". This is a parameter at the time of JBIG compression, and can be changed. Typically, 128 lines are recommended for JBIG code, and hence, the present exemplary embodiment follows this recommendation.

After necessary variables are reserved and initialized as described above, the flow advances to step S608. The CPU 111 refers to job information, and determines whether image data on a print job is described in PDL. If the image data is determined to be not described in PDL, the flow advances to step S614 (FIG. 7), and a process for obtaining the amount of blank on the basis of bitmap data is performed. On the other hand, if the image data is determined to be described in PDL, the flow advances to step S609. This is because of the following reason. For example, in the case of a copy job, the scanner 130 reads the original to print the obtained image data. The scanner 130, however, includes sensors such as CCD and CIS used for reading the original, and these sensors contain readout errors. In addition, light source may be uneven at the time of reading, and these make it unable to guarantee completely white data. Thus, it is difficult to calculate the number of blank lines on the basis of coded data obtained by coding the image data. This process is dependent on the current hardware control, however, this is not the case if the future technological advancement of scanners enables the calculation of the number of blank lines on the basis of the coded data obtained by coding the image data even at the time of copying.

The processes in step S609 to step S613 are processes for calculating the number of blank lines on the basis of the coded data. In step S609, the CPU 111 reserves an offset position Off in the RAM 112, and initializes it with "0". This process is to designate the offset position at the top of the code data memory. Next, the flow advances to step S610. The CPU 111 obtains two bytes of data on the offset position Off from the coded data memory. Then, the flow advances to step S611. The CPU 111 determines whether or not the two bytes of data are "0xFF02" or "0xFF03". The "0xFF02" or "0xFF03" indicate that a blank area extending across 128 lines exists, as described above with reference to FIG. 3. If they are determined to be "0xFF02" or "0xFF03" in step S611, the flow advances to step S612. The CPU 111 increases the number of continuous stripe end codes MC_num by one. Then, the flow advances to step S613. The CPU 111 increases the offset position Off by two (because reading out is performed every two bytes), and the flow advances to step S610.

On the other hand, if the data is determined to be data other than "0xFF02" or "0xFF03" in step S611, the CPU 111 determines that the data is data other than blank space, and the flow advances to step S614 to move to a process for analyzing the image data.

Here, for example, in the case where coded data read out by the coded data memory is 309 to 316 illustrated in FIG. 3, the offset position Off is "4", and the number of continuous stripe end codes MC_num is "2".

The flow advances to FIG. 7. In step S614, the CPU 111 obtains, from job information, a number of main scanning pixels Pix to analyze the bitmap data. In the case of the image data in FIG. 3, the number is "128". The flow advances to step S615. The CPU 111 divides the number of main scanning pixels Pix by "8", and stores the result in the number of bytes in the main-scanning direction Bnum_m reserved in the RAM 112. This results from the fact that the bitmap data is monochrome bi-level image data, and hence, one pixel is represented with one bit. Note that, in the exemplary embodiment, computation is made with each pixel being represented by one bit. However, one pixel may be represented by any other bits other than one bit, such as two bits and four bits. In addition, for example, each pixel may be represented by a fixed value of three bytes if the data are bitmap data with RBG 24 bits that was decoded from the coded data of JPEG compression.

Next, the flow advances to step S616. The CPU 111 calculates the offset position used for analyzing the bitmap data. This method of calculation uses the number of continuous stripe end codes MC_num, the StripeLine, and the number of bytes in the main scanning direction Bnum_m, which have been computed above. The number of blank lines is obtained through (MC_num)×(StripeLine), and the offset position is obtained by multiplying this number of blank lines by the number of bytes per line Bnum_m. The computed value obtained as described above is stored in the variable Off_i reserved in the RAM 112.

Next, the flow advances to step S617. The CPU 111 obtains the number of lines in the sub-scanning direction L in the image data. This is a protection process for avoiding calculating any area outside the bitmap area. Then, the flow advances to step S618. The CPU 111 initializes, with "0", the variable Bnum_t, reserved in the RAM 112, for counting the number of times that white continues in the image data. After this, the flow advances to step S619. The CPU 111 sets an analysis starting position Off in the image data to be the offset position of the offset position Off_i. As described above, the analysis starting position Off in the image data is skipped by the amount of blank obtained through analysis for the coded data memory to speed up the deciding process for the amount of blank space.

Next, the flow advances to step S620. The CPU 111 determines whether or not data on the analysis starting position Off indicates white. If yes, the flow advances to step S621, and the CPU 111 increases, by one, the variable Bnum_t indicating the number of times that white continues. Then, the flow advances to step S622. The CPU 111 determines whether or not examination is completed up to the trailing end of the bitmap data. If no, the flow advances to step S623, and the CPU 111 increases the analysis starting position Off by one, and advances to step S620. The processes of steps S620 to S623 are repeated until examination reaches data indicating other than white to compute the variable Bnum_t indicating the number of times that white continues.

If examination is completed up to the trailing end of the bitmap data in step S622 or if data on the analysis starting position Off does not indicate white in step S620, the flow advances to step S624. A continuing white line number, the number being calculated on the basis of the bitmap memory, is the value obtained by dividing the Bnum_t by Bnum_m, and hence, in step S624, the CPU 111 sets the value obtained by adding the continuing white line number and the number of blank lines calculated through analysis of the coded data together, as the number W_t of leading blank lines. Then, this process ends.

It should be noted that the exemplary embodiment describes the process of reading out bitmap data on a byte-by-byte basis to analyze it. However, the present invention is not limited to this. Depending on memory bus of the RAM 112 connected to the CPU 111, the processes may be performed faster by reading out two bytes or four bytes at a time and making determination. In the case where only the length of blank space in stripe units such as in units of 128 lines is required, it may be possible to skip the analysis of bitmap data, and compute the length of blank space. At the time of analyzing the bitmap data, 0x00 is used as data of white pixel to determine white pixels. However, depending on color space for image data, conditions for determination in step S620 may be changed such that 0xFF is used in the case of grayscale bitmap data and 0xFFFFFF is used in the case of RGB bitmap.

Figure 8:
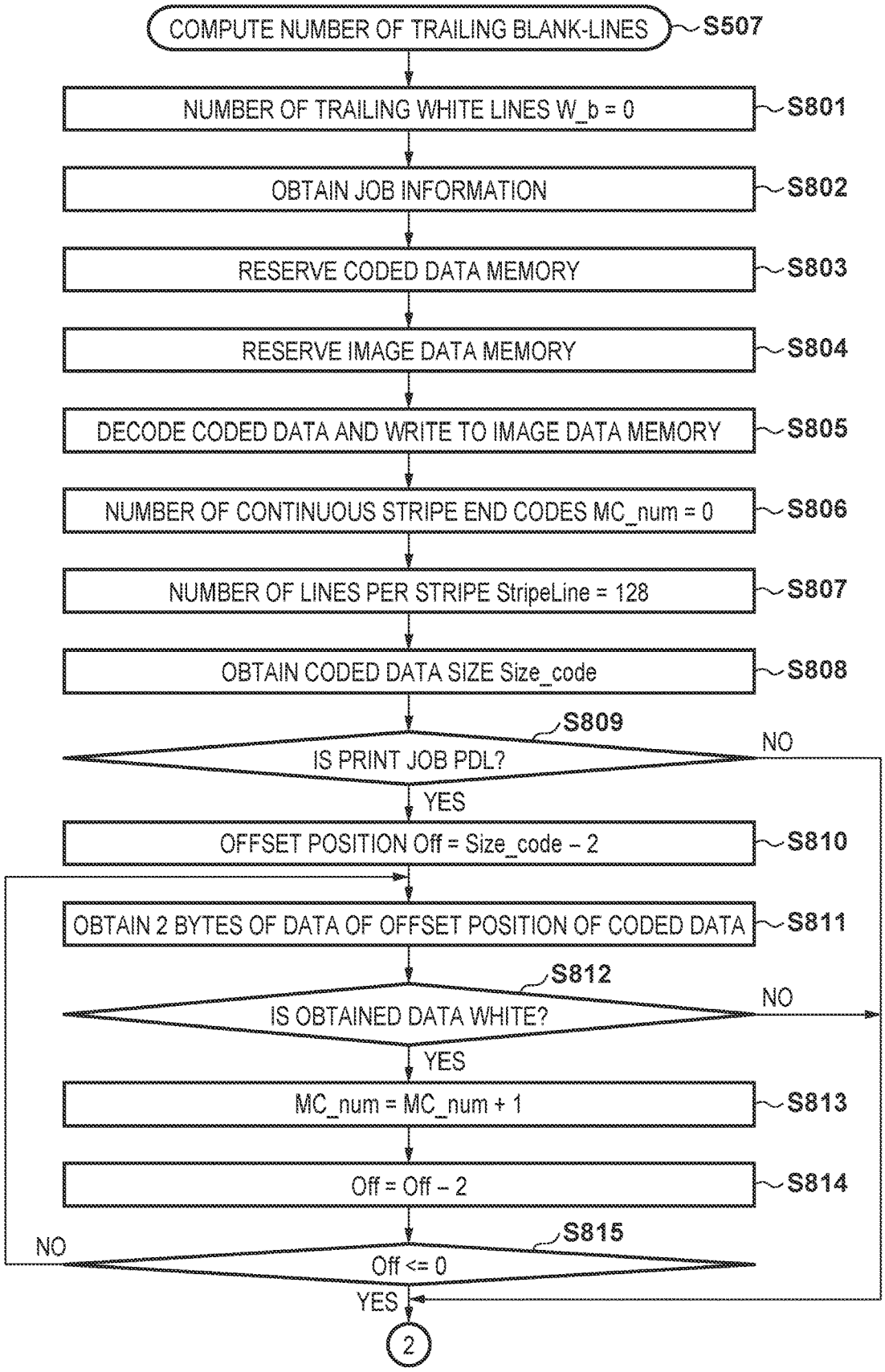
FIG. 8 is a flowchart for describing computation processing for the number of trailing blank lines in step S507 in FIG. 5.
Figure 9:
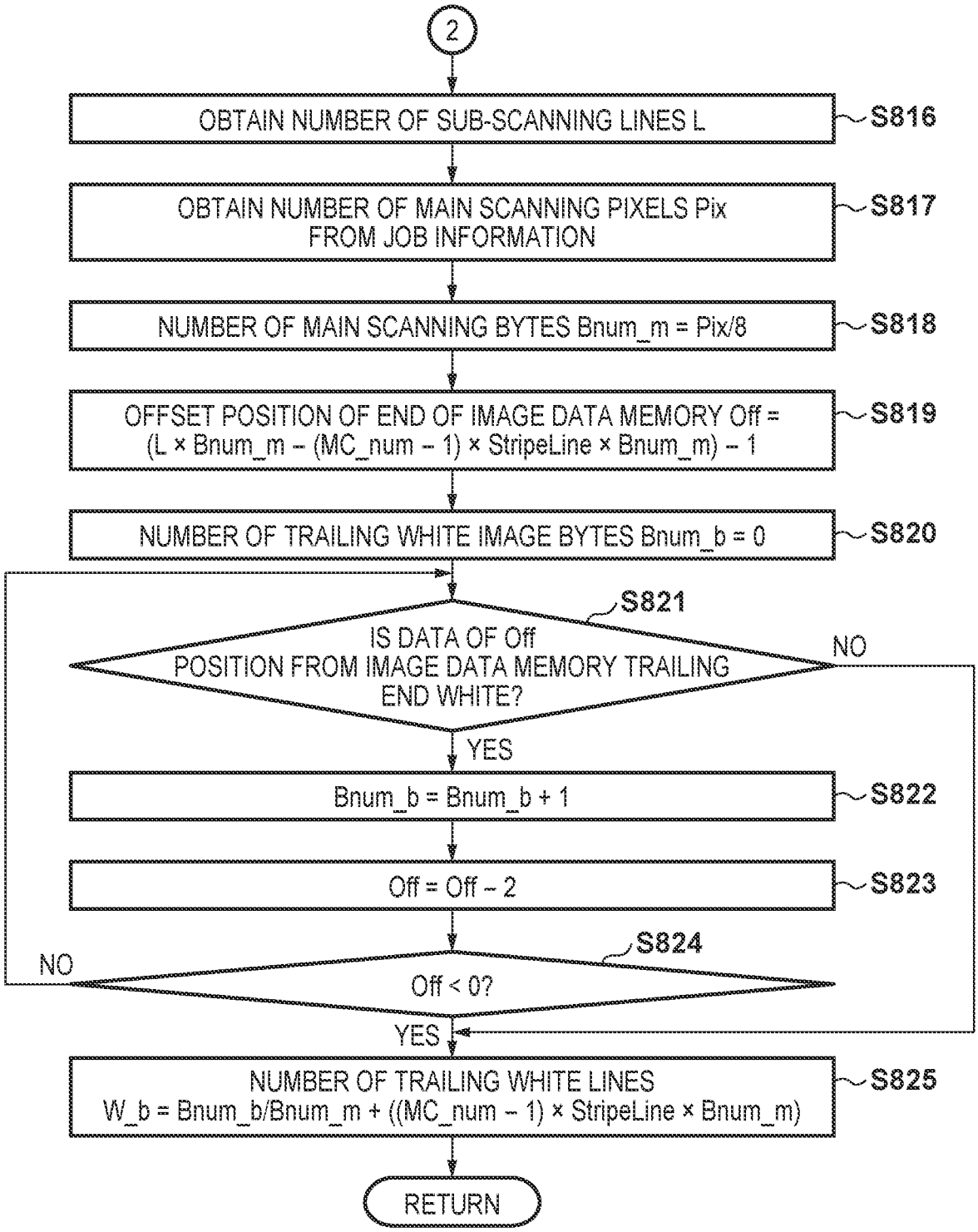
FIG. 9 is a flowchart for describing computation processing for the number of trailing blank lines in step S507 in FIG. 5.

FIGS. 8 and 9 are flowcharts for explaining computation processing for the number of trailing blank lines in step S507 in FIG. 5. The theory for the calculation processing for the number of trailing blank lines is the same as the calculation processing for the number of leading blank lines described above, and hence, explanation will be made with focus being placed on different points.

First, the processes in step S801 to step S807 are the same as those in step S601 to step S607 described above, and differ only in that the number of trailing blank-lines W_b is initialized. Here, each variable is initialized, necessary data and memories are reserved, and decoding processing is performed for image data. As for decoding of image data and reading-out of coded data, the computation processing for the number of trailing blank lines is performed after the computation processing for the leading blank line is performed. Thus, it may be possible to use the variables and memories used for the leading blank line described above as it is. In addition, as for the image data and the coded data, it may be possible to use the print data as it is, as the data to be transferred to the printer 140.

In step S808, the CPU 111 obtains the coded data size Size_code necessary for trailing-end determination processing for the coded data memory. This coded data size is based on the file size obtained from a file system when the coded data is read out from the image storage 120 to the coded data memory reserved in the image memory 119.

Next, the flow advances to step S809. The CPU 111 determines whether or not the image data is PDL data, as in step S608 in FIG. 6. Here, determination is made such that calculation of the number of blank lines on the basis of the coded memory is not performed for the print job containing the image data that is not described in PDL. The processes in step S810 to step S815 are processes for calculating the number of trailing blank lines on the basis of the coded data.

First, in step S810, the CPU 111 initializes the offset position Off. Here, processing is performed from the trailing end of the coded data to calculate the number of trailing blank lines. Thus, the offset position Off is set to Size_code−2, that means decreasing two from the coded data size Size_code obtained in step S808. This "−2" results from the fact that the marker code of JBIG is two bytes of "FF02" and "FF03". In the case of JPEG or other coding, the number of "A28A2800" is counted in the example illustrated in FIG. 4, and searching is performed from the position offset by four.

Next, the flow advances to step S811. The CPU 111 obtains two bytes of data on the offset position Off from the leading end of the coded data memory. In the example illustrated in FIG. 3, data of code 316 is obtained. Then, the flow advances to step S812. The CPU 111 determines whether or not the two bytes data is "0xFF02" or "0xFF03". If yes, the flow advances to step S813. The CPU 111 increases the value of the number of continuous stripe end codes MC_num by one. In the case of JBIG code, the "0xFF02" or "0xFF03" always exists at the end of the code, and hence, at least one number of continuous stripe end codes MC_num always exists even if no blank space exists at the end of the data. Thus, the processes of step S813 and subsequent steps are performed at least once. The position to be offset in step S810 is set to the position of −4 bytes, and initialization in step S806 is made with "1" rather than with "0", whereby the determination processing for this one time at the trailing end can be skipped. In this exemplary embodiment, due to commonality with the calculation processing for the number of leading blank lines, the same initialization is performed, and description thereof will not be repeated. The determination processing for "FF02" or "FF03" and the counting processing for the number of times in the calculation processing for the number of trailing blank lines are performed in the same manner as those in the calculation processing for the number of leading blank lines described above. However, they differ in that, in step S814, the offset position Off is decreased by two. Then, if the offset position Off falls in or below zero in step S815, it is assumed that examination has been made up to the leading end of the coded data memory and all are white data, and then, the flow advances to step S816 (FIG. 9). However, as described above, in the case where all are white data, it may be possible to make detection through other methods, and skip the calculation processing for the number of leading blank lines and the number of trailing blank lines.

The processes in step S817 to step S818 are similar to those in step S614 to step S615 for calculation processing for the number of leading blank lines described above, except that, in step S816, the number of lines in the sub-scanning direction L in the image data is obtained from the job information to judge whether processing ends, and hence, description thereof will not be repeated.

Next, the flow advances to step S819. The CPU 111 calculates the offset position Off that indicates the position of the trailing end of the bitmap data in the image memory. This can be computed by multiplying the number of lines in the sub-scanning direction L obtained in step S816 by the number of bytes in the main scanning direction Bnum_m, subtracting (MC_num−1)×StripeLine×Bnum_m from the multiplied value, and subtracting one from the resulting value. This is to omit the position of the blank line at the trailing end, which is analyzed from the coded data memory, from the calculation target, thereby achieving high speed computation.

Next, the flow advances to step S820. The CPU 111 reserves, in the RAM 112, the number of bytes of white pixels at the trailing end Bnum_b, and initializes it with "0". Then, the flow advances to step S821. The CPU 111 reads out, from the image memory, data on the offset position Off from the trailing end in the image memory, and determines whether or not the data indicates "0" (white). If it is determined to be "0", the flow advances to step S822, and the CPU 111 increases the number of bytes of white pixels at the trailing end Bnum_b by one. Then, the flow advances to step S823. The CPU 111 decreases the offset position Off by 2. This is to move the position of determination toward the leading end by two bytes. Then, the flow advances to step S824. The CPU 111 determines whether or not determination is completed to bitmap data up to the leading end of the image memory. The processes of step S821 to step S824 are repeated as described above to calculate the number of bytes up to the position where the non-white pixel value exists, from the trailing end of the bitmap data toward the leading end.

If determination to the bitmap data is made up to the leading end of the image memory in step S824, or the data on the offset position Off is not "0" in step S821, the flow advances to step S825. In step S825, the CPU 111 calculates the number of trailing blank lines W_b using {Bnum_b/Bnum_m+(MC_num−1)/StripeLine×Bnum_m}. This enables the number of trailing blank lines to be obtained. The computation of the amount of blank area on the basis of bitmap data can be more efficiently performed as the resolution of image data increases.

For example, the case where a landscape image with A4 (210 mm×297 mm) is considered. In addition, description will be made of an example in which computation is made with 600 dpi and a blank space that exists in 128 lines at the leading end is calculated. In the case where analysis is made on the basis of bitmap data, it is necessary to read out 112240 bytes of data, which is obtained through 7015 pixels×128 lines/8, to make examination as to whether data other than "0" exists. On the other hand, in the case where analysis is made on the basis of coded data, determination only involves two bytes. In addition, in the case of 1200 dpi, it is necessary to analyze 14030×128/8=224480 bytes of data to make determination as to white pixels. Thus, there is provided an effective method for calculating the number of blank lines in high-resolution data.

In addition, it may be possible to switch between obtaining the number of blank lines only through analysis of bitmap data and not obtaining the amount of blank area through analysis of bitmap data, depending on the resolution of the image data.

As described above, according to the exemplary embodiment, it is possible to reduce the amount of analysis of bitmap data, the number of times of access to the RAM 112, the number of times of arithmetic operation by the CPU, and the like to obtain the number of blank lines at high speed.

Next, operations of the printer 140 according to the exemplary embodiment will be described. In the case where the overlapping amount of sheets is set, the printer 140 is assumed to perform printing in a manner such that sheets are conveyed so that the preceding sheet overlaps with part of the succeeding sheet.

Figure 10A:
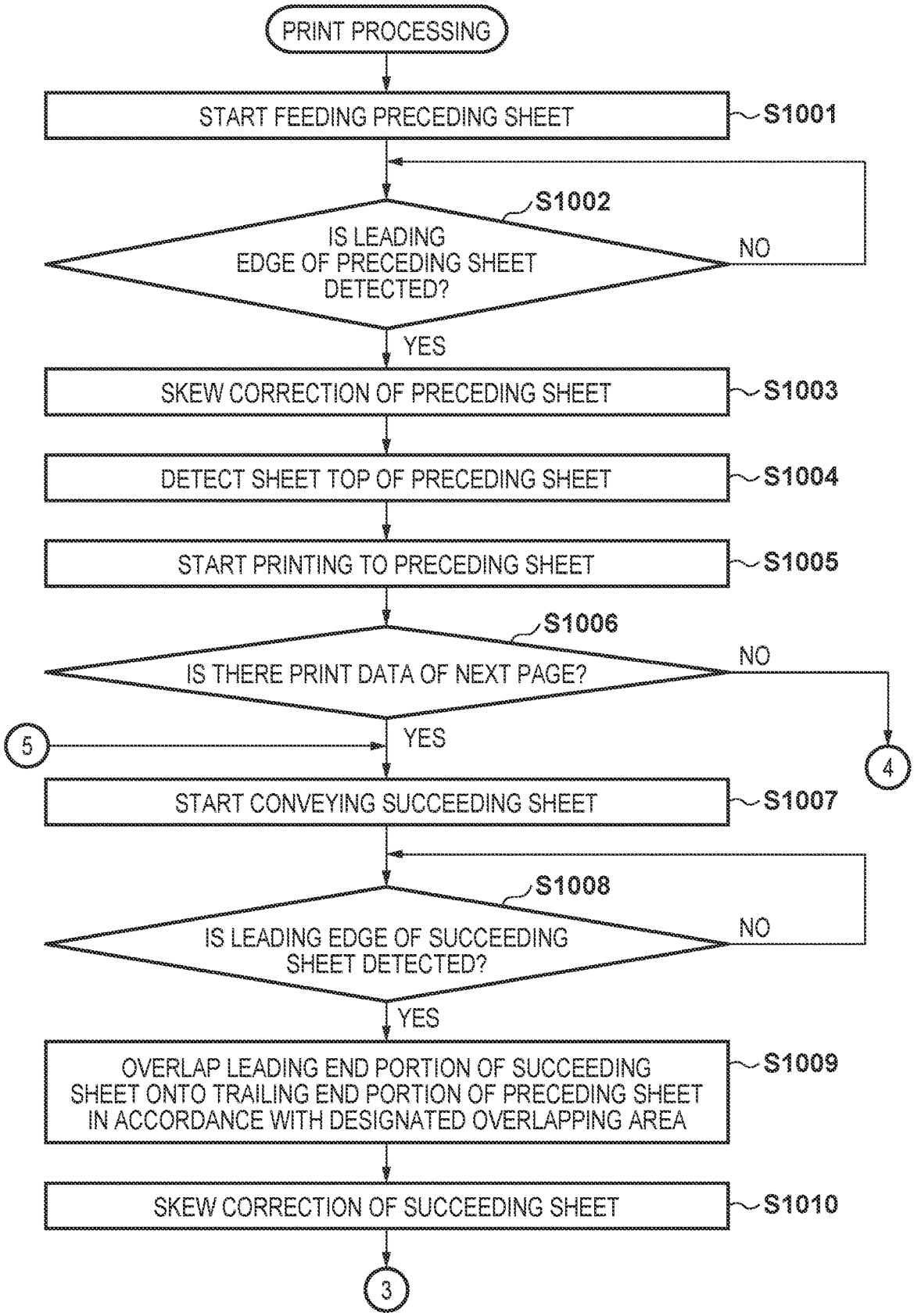
FIGS. 10A and 10B are flowcharts for describing a print processing by a printer according to the exemplary embodiment.
Figure 10B:
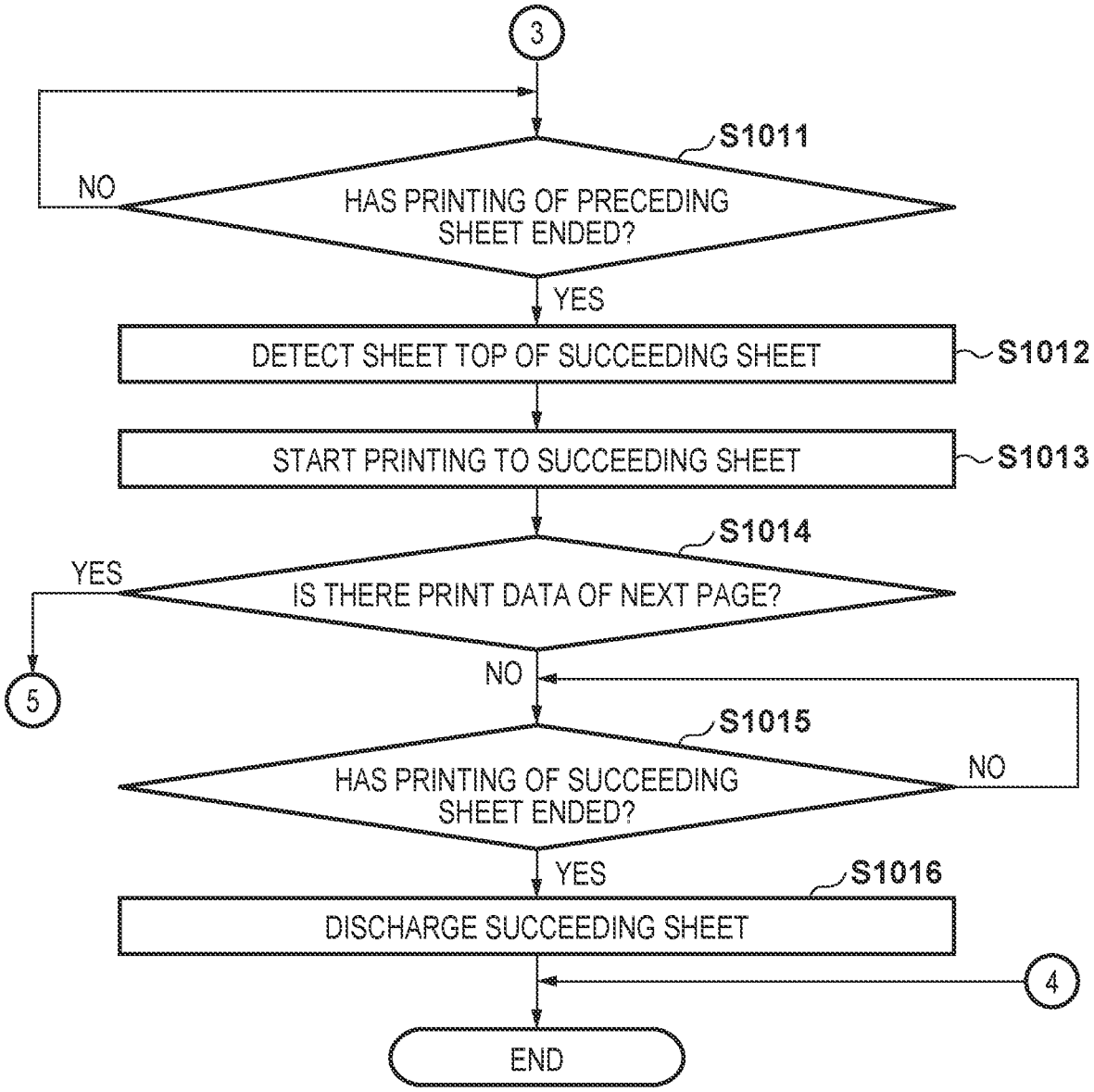

FIGS. 10A and 10B are flowcharts for describing the print processing performed by the printer 140 according to the exemplary embodiment. This process is started by the printer 140 receiving print data outputted by the control unit 110 and data indicating the overlapping area in step S509 or step S510 in FIG. 5.

First, in step S1001, the printer 140 starts to feed the preceding sheet on which the first page of the print data is printed. Next, in step S1002, the printer 140 waits until the leading end of the sheet is detected by a sheet detection sensor, and the flow advances to step S1003 to correct the skew of the sheet. After this, the flow advances to step S1004 to detect the sheet top of the sheet on the basis of the print data on the page. Then, in step S1005, printing to the sheet is started.

Next, the flow advances to step S1006. The printer 140 determines whether or not print data on the next page exists. If no print data on the next page is determined to exist, the printer 140 waits until ending of printing of the page, the printer 140 discharges sheets on which printing has been completed, and ends this process. On the other hand, if print data on the next page is determined to exist, the flow advances to step S1007, and the printer 140 starts to feed the succeeding sheet on which the print data on the next page is printed. Then, in step S1008, the printer 140 waits until the leading end of the succeeding sheet is detected by the sheet detection sensor, and the flow advances to step S1009 to feed the succeeding sheet so that the leading end portion of the succeeding sheet overlaps with the trailing end portion of the preceding sheet by the length corresponding to the designated overlapping area. Then, in step S1010, the skew of the succeeding sheet is corrected.

Next, the flow advances to step S1011 to determine whether or not printing to the preceding sheet is completed. If printing to the preceding sheet is completed, the flow advances to step S1012 to detect the sheet top of the succeeding sheet. Then, in step S1013, printing to the succeeding sheet is started. After this, the flow advances to step S1014 to determine whether or not print data on the next page exists, as in step S1006. If the print data on the next page is determined to exist, the flow advances to step S1007 to perform processing similar to that described above. On the other hand, if no print data on the next page exists, the flow advances to step S1015 to wait until ending of printing of the page, discharge the printed sheet in step S1016, and end this process.

It should be noted that, in the exemplary embodiment described above, after a code in which not all is "0" is found, the number of blank lines that continue in the code is obtained to obtain the amount of blank space by adding up the obtained number of blank lines and the number of lines corresponding to the codes containing only "0" and continuing up to that point together. However, if the code in which not all is "0" is found, it may be possible to obtain the amount of blank space on the leading end side or the trailing end side only on the basis of the number of codes containing only "0" and continuing up to that point. Here, for example, in the case of codes that have been subjected to JBIG compression described above, one code corresponds to 128 lines. Thus, if the amount of blank space is obtained on the basis of the number of codes continuing until the code in which not all is "0" is found, the obtained amount differs from the amount of blank space obtained in the exemplary embodiment described above by the amount of 128 lines at maximum. For example, in the case of printing with 1600 dpi, the length results in 25.4 mm×(128/1600)=2.032, and hence, the difference results in approximately 2 mm. Thus, it can be considered that no significant trouble arises if the amount of blank space on the leading end side or the trailing end side is obtained only on the basis of the number of codes containing only "0" and continuing up to that point, in the case where any code in which not all is "0" is found.

Other Embodiments

Embodiments of the present invention can also be realized by a computer of a system or apparatus that reads out and executes computer executable instructions (e.g., one or more programs) recorded on a storage medium (which may also be referred to more fully as 'non-transitory computer-readable storage medium') to perform the functions of one or more of the above-described embodiments and/or that includes one or more circuits (e.g., application specific integrated circuit (ASIC)) for performing the functions of one or more of the above-described embodiments, and by a method performed by the computer of the system or apparatus by, for example, reading out and executing the computer executable instructions from the storage medium to perform the functions of one or more of the above-described embodiments and/or controlling the one or more circuits to perform the functions of one or more of the above-described embodiments. The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2017-234303, filed Dec. 6, 2017, which is hereby incorporated by reference herein in its entirety.

What is claimed is:

1. An image forming apparatus comprising:

a sheet conveying unit configured to convey a sheet;

an image forming unit configured to form an image;

a memory device configured to store a set of instructions;

at least one processor configured to execute the instructions stored in the memory device to function as:

a detection unit configured to detect a predetermined code in compressed image data;

a first obtaining unit configured to obtain a first length of a first blank in a sheet conveying direction on a trailing end side of a first sheet on the basis of a detection result of the predetermined code in an area corresponding to the first sheet in the compressed image data;

a second obtaining unit configured to obtain a second length of a second blank in the sheet conveying direction on a leading end side of a second sheet to be conveyed after the first sheet on the basis of a detection result of the predetermined code in an area corresponding to the second sheet in the compressed image data; and a control unit configured to control, based on the first length and the second length, the sheet conveying unit to convey the second sheet such that the second sheet overlaps with the first sheet by a length shorter than the first length and the second length, and to control the image forming unit to form an image on the first sheet and to form an image on the second sheet.

2. The image forming apparatus according to claim 1, wherein the image data is coded data that has been coded in units of plural lines, and the first obtaining unit is configured to obtain the first length on the basis of an amount of continuation of the predetermined code from the top of the coded image data, the predetermined code indicating a blank area contained in the coded image data in the units of plural lines.

3. The image forming apparatus according to claim 2, wherein the first obtaining unit is configured to further obtain, in the units of plural lines, a position of a line where the predetermined code contained in the coded image data stops continuing, and also obtain the first length by adding together the amount of continuation of the predetermined code from the top of the coded image data and a blank amount up to the position of the line in image data decoded from the image data.

4. The image forming apparatus according to claim 3, wherein the second obtaining unit is configured to obtain the second length on the basis of an amount of continuation of a predetermined code from the trailing end of the coded image data, the predetermined code indicating a blank area contained in the coded image data in the units of plural lines.

5. The image forming apparatus according to claim 4, wherein the second obtaining unit is configured to further obtain, in the units of plural lines, a position of a line where the predetermined code contained in the coded image data stops continuing, and also obtain the second length by adding together the amount of continuation of the predetermined code from the trailing end of the coded image data and a blank amount up to the position of the line in image data decoded from the image data.

6. The image forming apparatus according to claim 1, wherein the image data are coded data that have been coded in units of rectangular blocks, and the first obtaining unit is configured to obtain the first length on the basis of an amount of continuation of a code from the top of the coded data, the code indicating a blank area contained in the coded data in the units of a block.

7. The image forming apparatus according to claim 6, wherein the first obtaining unit is configured to further obtain, in the units of a block, a position of a line where the code contained in the coded data stops continuing, and also obtain the first length by adding together the amount of continuation of the code from the top of the coded data and a length up to the position of the line in image data decoded from the image data.

8. The image forming apparatus according to claim 6, wherein the second obtaining unit is configured to obtain the second length on the basis of an amount of continuation of a code from the trailing end of the coded data, the code indicating a blank area contained in the coded data.

9. The image forming apparatus according to claim 8, wherein the second obtaining unit is configured to further obtain, in the units of a block, a position of a line where the code contained in the coded data stops continuing, and also obtain the second length by adding together the amount of continuation of the code from the trailing end of the coded data and a length up to the position of the line in image data decoded from the image data.

10. The image forming apparatus according to claim 1, further comprising:

a coding unit configured to code the image data to the coded image data.

11. The image forming apparatus according to claim 2, wherein the coded image data is coded image data that has been subjected to JBIG compression.

12. The image forming apparatus according to claim 6, wherein the coded image data is coded image data that has been subjected to JPEG compression.

13. The image forming apparatus according to claim 1, wherein previous image data to be coded into the image data that has been coded is image data developed from a page description language.

14. A method of controlling an image forming apparatus including a sheet conveying unit configured to convey a sheet and an image forming unit configured to form an image, the method comprising:

detecting a predetermined code in compressed image data;

obtaining a first length of a first blank in a sheet conveying direction on a trailing end side of a first sheet on the basis of a detection result of the predetermined code in an area corresponding to the first sheet in the compressed image data;

obtaining a second length of a second blank in the sheet conveying direction on a leading end side of a second sheet to be conveyed after the first sheet on the basis of a detection result of the predetermined code in an area corresponding to the second sheet in the compressed image data; and controlling, based on the first length and the second length, the sheet conveying unit to convey the second sheet such that the second sheet overlaps with the first sheet by a length shorter than the first length and the second length, and to control the image forming unit to form an image on the first sheet and to form an image on the second sheet.

15. A non-transitory computer-readable storage medium storing a program for causing a processor to execute a method of controlling an image forming apparatus including a sheet conveying unit configured to convey a sheet and an image forming unit configured to form an image, the method comprising:

detecting a predetermined code in compressed image data;

obtaining a first length of a first blank in a sheet conveying direction on a trailing end side of a first sheet on the basis of a detection result of the predetermined code in an area corresponding to the first sheet in the compressed image data;

obtaining a second length of a second blank in the sheet conveying direction on a leading end side of a second sheet to be conveyed after the first sheet on the basis of a detection result of the predetermined code in an area corresponding to the second sheet in the compressed image data; and controlling, based on the first length and the second length, the sheet conveying unit to convey the second sheet such that the second sheet overlaps with the first sheet by a length shorter than the first length and the second length, and to control the image forming unit to form an image on the first sheet and to form an image on the second sheet.

16. The image forming apparatus according to claim 1, wherein the second obtaining unit obtains, on the basis of the number of blank lines, the second length.

* * * * *